US010290172B2

(12) United States Patent
Ghouri et al.

(10) Patent No.: US 10,290,172 B2
(45) **Date of Patent: *May 14, 2019**

(54) AUTOMATED MEDICATION DISPENSING SYSTEM AND METHOD

(71) Applicant: Humana Inc., Louisville, KY (US)

(72) Inventors: Ahmed Ghouri, San Diego, CA (US); Sheldon Ball, La Jolla, CA (US)

(73) Assignee: Humana Inc., Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/161,641

(22) Filed: Oct. 16, 2018

(65) Prior Publication Data

US 2019/0051084 A1 Feb. 14, 2019

Related U.S. Application Data

(63) Continuation of application No. 15/652,581, filed on Jul. 18, 2017, now Pat. No. 10,134,219, which is a continuation of application No. 14/136,837, filed on Dec. 20, 2013, now Pat. No. 9,741,197.

(60) Provisional application No. 61/746,358, filed on Dec. 27, 2012.

(51) Int. Cl.

| | |
|---|---|
| ***G07F 7/08*** | (2006.01) |
| ***G07F 11/00*** | (2006.01) |
| ***G07F 17/00*** | (2006.01) |

(52) U.S. Cl.

CPC ..... *G07F 11/002* (2013.01); *G07F 17/0092* (2013.01)

(58) Field of Classification Search

CPC ..... G07F 7/08; G07F 11/002; G07F 17/0092

USPC ..... 700/236, 244, 242

See application file for complete search history.

(56) References Cited

U.S. PATENT DOCUMENTS

| | | | | |
|---|---|---|---|---|
| 6,304,797 | B1 | 10/2001 | Shusterman | |
| 6,529,801 | B1 | 3/2003 | Rosenblum | |
| 7,857,161 | B2 | 12/2010 | Pinney et al. | |
| 8,600,548 | B2 | 12/2013 | Bossi et al. | |
| 8,700,212 | B1 | 4/2014 | Bruno et al. | |
| 9,741,197 | B2 * | 8/2017 | Ghouri | G07F 17/0092 |
| 10,134,219 | B2 * | 11/2018 | Ghouri | G07F 11/002 |
| 2004/0050855 | A1 | 3/2004 | Jurgenson | |
| 2007/0010910 | A1 | 1/2007 | Pinney et al. | |
| 2007/0185615 | A1 | 8/2007 | Bossi et al. | |
| 2008/0059228 | A1 | 3/2008 | Bossi et al. | |
| 2008/0077274 | A1 | 3/2008 | Kim | |

(Continued)

*Primary Examiner* — Michael Collins

(74) *Attorney, Agent, or Firm* — Standley Law Group LLP

(57) ABSTRACT

A system and method for automating the dispensation of medication is provided. Electronic medical record data including identifying data and medication data for an individual is received at a server. The medication data is analyzed to identify at least one medication for dispensation. An instruction is initiated to load said identified medication in an automated medication dispenser and the automated medication dispenser is loaded with a dosing tray in the form of a replenishable, standardized cartridge. Status data is received from the automated medication dispenser regarding the dispensation of the identified medication and medication dosages remaining. At least one image of a user interacting with the automated medication dispenser is provided from a monitoring component which is in electronic communication with said automated medication dispenser.

20 Claims, 4 Drawing Sheets

(56) References Cited

U.S. PATENT DOCUMENTS

| | | | |
|---|---|---|---|
| 2008/0119958 | A1 | 5/2008 | Bear et al. |
| 2008/0269947 | A1 | 10/2008 | Beane |
| 2011/0133948 | A1 | 6/2011 | Ervin |

* cited by examiner

AUTOMATED MEDICATION DISPENSING SYSTEM AND METHOD

CROSS-REFERENCE TO RELATED APPLICATIONS

This application is a continuation of U.S. application Ser. No. 15/652,581 filed Jul. 18, 2017, which is a continuation of U.S. application Ser. No. 14/136,837, filed Dec. 20, 2013, now U.S. Pat. No. 9,741,197, which claims priority to U.S. Provisional Application No. 61/746,358 filed on Dec. 27, 2012. All of the aforementioned applications are hereby incorporated by reference as if fully recited herein.

BACKGROUND

At-home medication administration in patients with multiple chronic conditions, especially the elderly, is a process fraught with potential disasters. Certain health conditions may require a patient to take as many as 30-40 doses per day of various medications. Furthermore, there may dozens of prior historical medicines in every room of the house. Some patients may be confused by the different current and prior medicines and refrain from taking any of them for fear of taking the wrong medicine, taking the medicine at the wrong time, or both. Other patients are at risk for overmedicating themselves by taking the old or even the new medicines without regard to proper dosage and timing. The inability to adhere to a strict medication regime can result in patients under- or overmedicating themselves and in additional health concerns that must be addressed.

One reason medicines accumulate in a patient's home is that new medications may be started every time the patient is discharged from a hospital or other medical facility. In some instances, not only are new medications started, the dosing schedule of prior medications may change. New medications may be prescribed and started without regard to the fact the patient may not have finished prior fills of the same or similar medications. In some instances, prior medications may no longer be appropriate for the patient's current condition. For patients that have more than one in-patient care episode a year, the number of unfinished fills may be substantial. For health benefits providers that offer benefits to a large number of elderly or chronically ill patients, costs of care for members that are on numerous medications may also be substantial. Some studies indicate that up to 800 per 1000 members with congestive heart failure are readmitted every year for that disease alone. Many of these readmissions may be reduced with proper medication administration.

Although elderly and chronically ill patients may obtain substantial benefits from staying in their own homes as long as possible, remaining at home may not be an option if the patient is unable to adhere to a medication regime. Continuous monitoring at home of 30-40 doses per day is often logistically impossible, even with family or other caretaker support. Even if a caretaker is sent periodically to assist the patient, it is impossible to know what the patient may have taken when no one was present. Therefore, there is a need for an automated prescription dispensing system and method for controlling a prescription dispenser that is located at home to assist chronically ill and elderly patients with medication administration.

SUMMARY

The present disclosure is directed to an automated prescription dispensing system and method. In an example embodiment, the system facilitates dispensing of prescriptions from a prescription dispenser designed for in-home use. The prescription dispenser may be Internet-enabled for remote monitoring and comprises a personalized dosing tray or cartridge that is presented to a patient. The dispenser may connect to a remote patient monitoring center for monitoring of the patient's dispenser use and adherence to the medication regime. The dispenser may further connect to a remote medication operations center for monitoring replenishment of the patient's medications and to a remote medical center for monitoring the patient's reaction to medications and clinical signs. A connection to an Internet-enabled data analytics center and analytical engine facilitates communications among and between the users and/or caregivers at the remote centers.

In an example embodiment, the prescription dispenser may be loaded with a dosing tray in the form of a replenishable, standardized cartridge. The cartridge may be replenished using a service that reloads and delivers the cartridges according to the patient's needs. In an example embodiment, the dispenser is further equipped with a camera or other monitoring component that allows a remote caregiver at the remote patient monitoring center to view the patient while the patient uses the dispenser. The camera may be used to take photographs or streaming video of the patient when the dispenser is in use. The image data may be accessible or transmitted to a caregiver in real-time or for later viewing. The image data may provide a caregiver with important information about the status of a patient's condition and may alert a caregiver when a patient is confused, disoriented, or otherwise in need of assistance.

In an example embodiment, a patient's medications are dispensed once a day with instructions (e.g., every morning). The patient is required to follow only that day's instructions. The automated prescription dispensing system and method and the prescription dispenser, therefore, simplify medication administration for the patient and reduces the likelihood of medication errors. As a result, it reduces the likelihood of a patient becoming under- or over-medicated and it reduces the likelihood of healthcare facility admissions due to medication errors. Also, due to remote, real-time monitoring, dangerous drug combinations may be detected and withheld by the dispenser until an override occurs. Finally, it reduces costs for healthcare benefits providers and their members.

DETAILED DESCRIPTION

Figure 1:
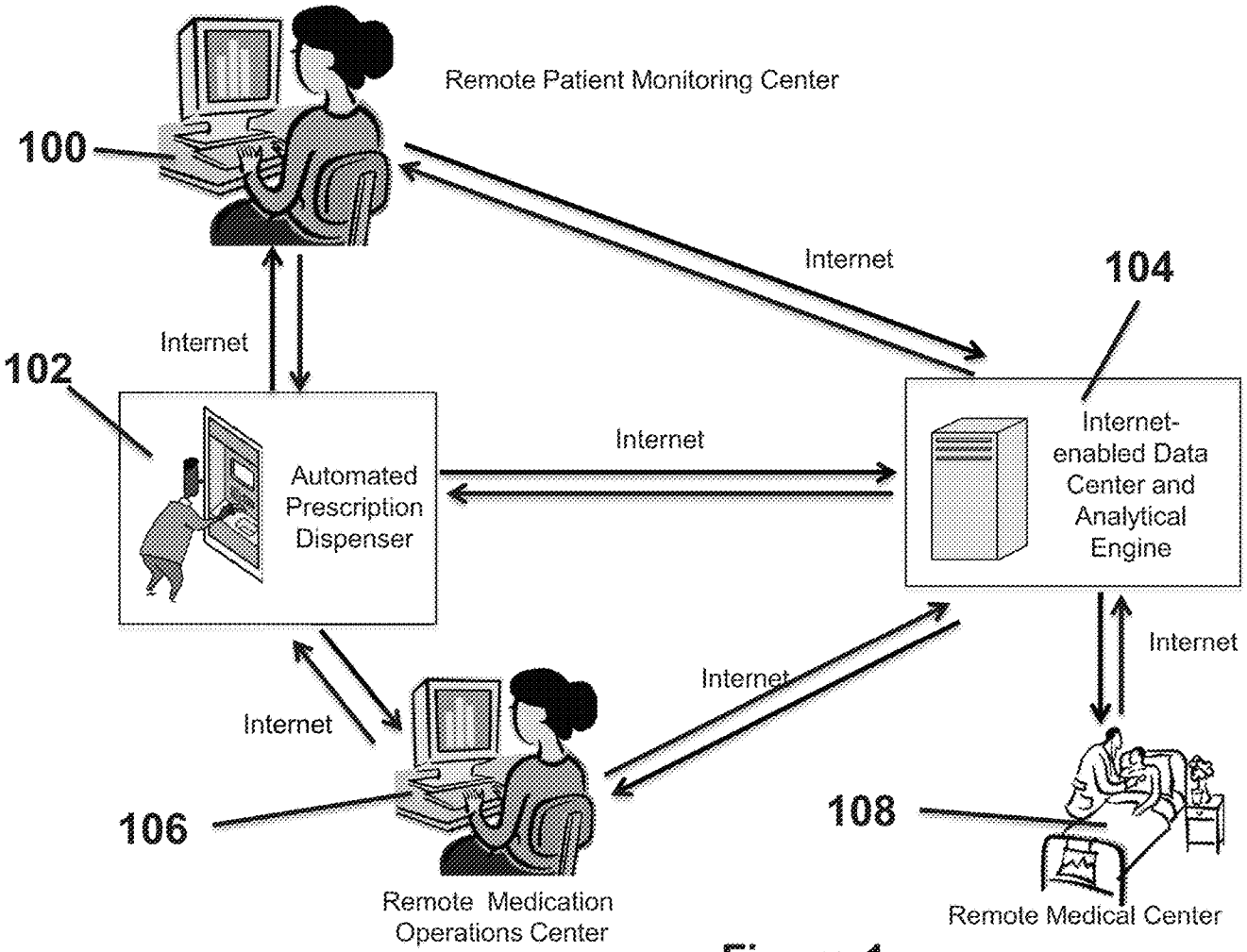
FIG. 1 is an automated prescription dispensing system network topology according to an example embodiment.

Referring to FIG. 1, an automated prescription dispensing system network topology according to an example embodiment is shown. Automated prescription dispensers 102 are installed in patient homes. The dispensers comprise a dispensing tray or cartridge that holds each patient's medications. The dispensers are Internet-enabled and accessible from one or more remote centers. The automated prescription dispensers 102 may be programmed to transmit information periodically or continuously to the remote centers and to permit remote access from users at remote centers. In addition to transmitting and receiving data, the automated prescription dispensers 102 may have remote administration capabilities to facilitate software and other system updates at the devices.

Users at a remote medication operations center 106 monitor the inventory of prescriptions and medications in each patient's dispenser and arrange to replenish each dispenser according to each patient's needs. Users at a remote patient monitoring center 100 monitor patient use of the dispensers. Status data regarding the patient's use of the dispenser as well as data indicative of the patient's condition while using the dispenser may be transmitted to the remote patient monitoring center 100 so that a user can confirm the patient is using the dispenser properly and has not experienced any adverse events related to using the dispenser, taking the medications, etc. A connection between the dispenser 102 and a remote data analytics server center 104 facilitates the transmission of data regarding the appropriate prescriptions and medications to be dispensed to the patient. Data related to the patient's prescriptions and medications is received at the data analytics center 104 from a remote medical center 108. Such a medical center may comprise a medical center server which contains patient data. An analytical engine at the data analytics center 104 may detect changes in the patient's prescriptions or medications based on data in electronic medical records received from the remote medical center 108. If a doctor changes a patient's medication or dosage, data for the dispenser is updated automatically and seamlessly.

Remote patient monitoring services as well as medication operations services may be provided by a single service provider or multiple service providers. One of skill in the art would understand that one or more software applications executing on one or more servers at one or more locations may support the remote patient monitoring services as well as remote medication operations services. One of skill in the art would understand there are various ways to implement the features and functionality described herein in one or more software applications and that the topology shown in FIG. 1 is illustrative of one possible embodiment.

Figure 2:
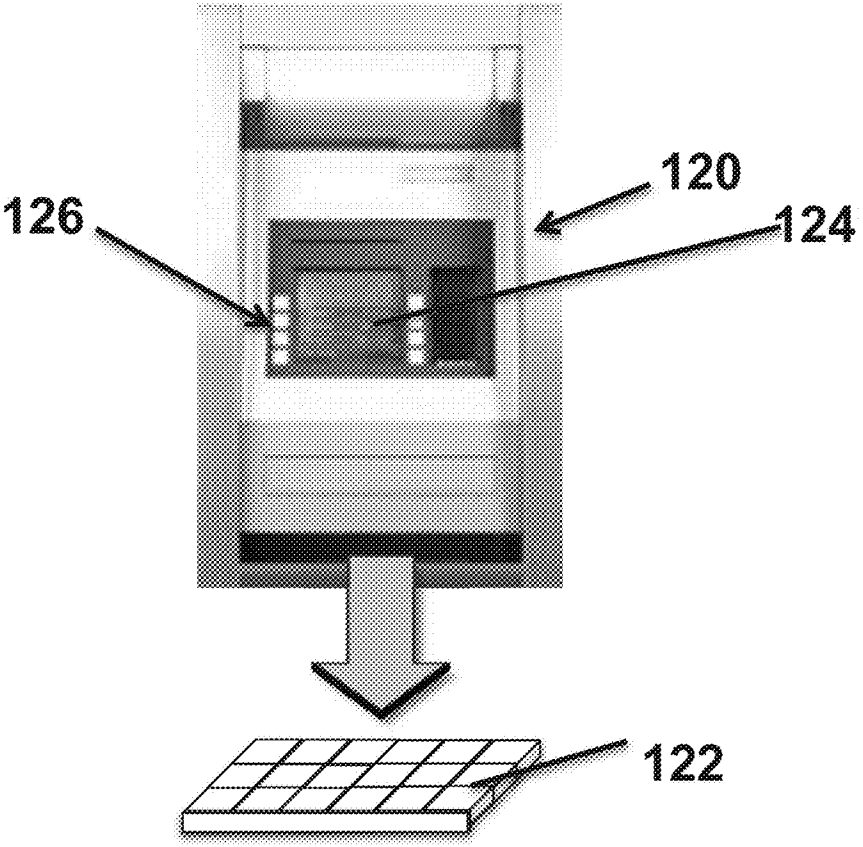
FIG. 2 is a diagram of an automated prescription dispenser according to an example embodiment.

Referring to FIG. 2, a diagram of an automated prescription dispenser according to an example embodiment is shown. In an example embodiment, the dispenser 120 comprises a release component or mechanism (e.g., button or lever) to release a dispensing tray or cartridge from the dispenser. The dispenser may further comprise a computer display 124 and one or more buttons 126 for interacting with the dispenser. The dispenser dispenses medications in a standardized tray or cartridge 122 that can be reloaded according to the patient's needs.

For security purposes, the dispenser 120 may be equipped with a security component such as a scanner or sensor to perform biometric validation. For example, the dispenser may be equipped with a finger print or retinal scanner. Biometric validation provides easy and secure access and frees the patient from having to remember and enter a code. The dispenser 120 may have an alert feature (e.g., flash and/or beep) when a cartridge or tray 122 is dispensed so the patient knows the validation was successful.

The dispenser 120 may be programmed to allow access only once per day. It may further detect when the dispenser is not accessed or the dispensed tray or cartridge 122 is not lifted after a configurable inactivity period such as 8 to 24 hours. Using the Internet connectivity features, the dispenser may be programmed to issue an alert to a remote caregiver if the patient fails to access the dispenser or lift the tray or cartridge 122 within the specified time period.

When the tray or cartridge is lifted, a camera may start to capture streaming video or photographs for viewing at a remote monitoring station. The viewer can examine patient habitus (e.g., edema, shortness of breath, instability). A patient that is experiencing difficulty in using the dispenser or that exhibits another health condition or acute episode may access a "Do Not Understand" or "Panic" button for immediate assistance via voice and/or video. In an example embodiment in which two-way communication is supported, a remote caregiver may communicate with the patient and ask questions or notify the patient that help is on the way.

Figure 3:
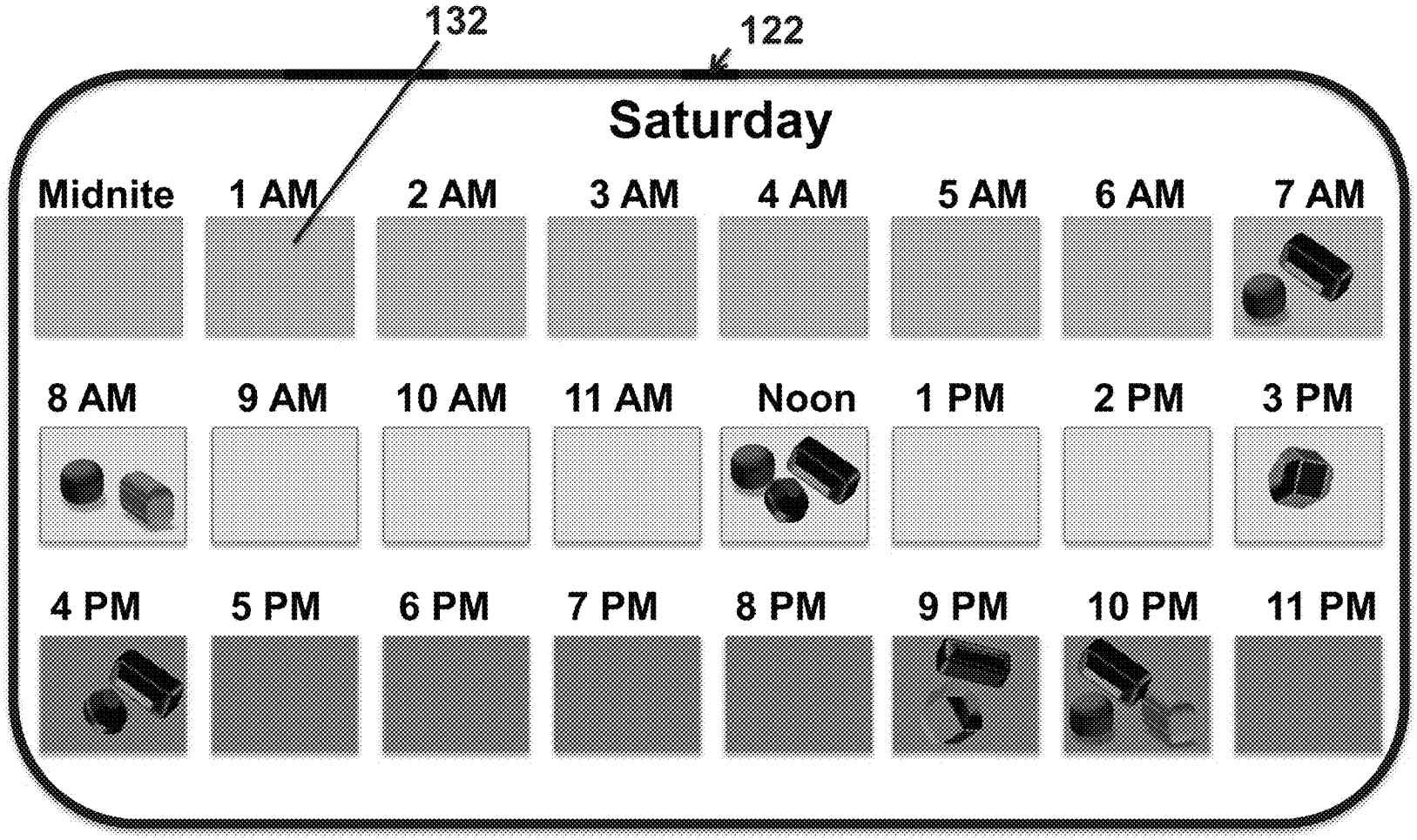
FIG. 3 is a sample dispensing tray layout according to an example embodiment.

Referring to FIG. 3, a sample dispensing tray or cartridge 122 according to an example embodiment is shown. In an example embodiment, the dispenser dispenses a "One Tray Per Day Unambiguous Single Day Planner" cartridge 122. The tray or cartridge 122 comprises a plurality of compartments 132 corresponding to different times of the day. In an example embodiment, the tray or cartridge comprises 24 compartments, one for each hour of the day. In an alternative embodiment, the tray may comprise three compartments: one for morning; one for afternoon; and one for evening. The trays or cartridges may be configured in a variety of ways to meet the needs of different patient populations. Each compartment 132 may be loaded with the pills or medications the patient should take at the specified time of day.

Figure 4:
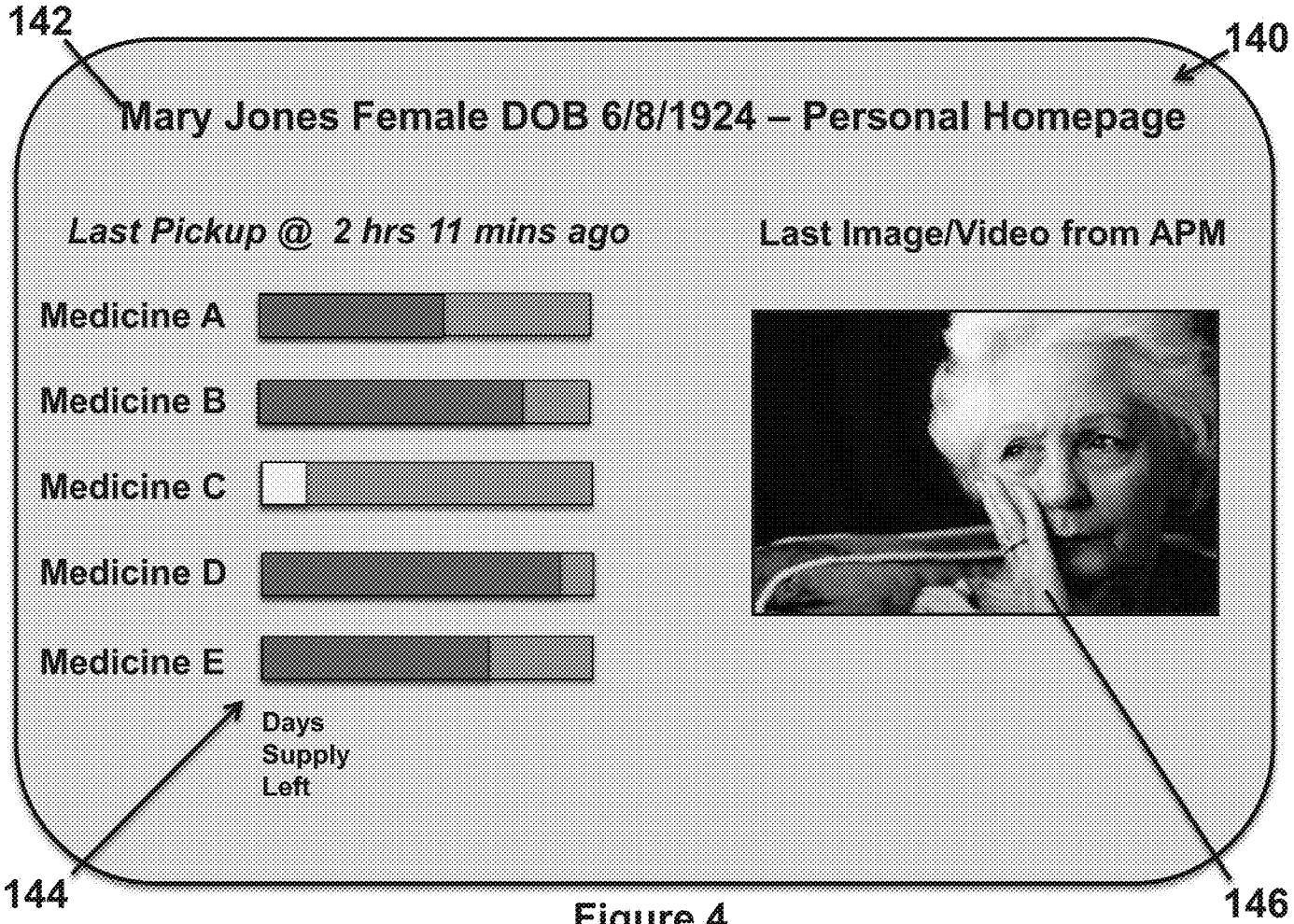
FIG. 4 is a sample monitoring screen display according to an example embodiment.

Using a remote monitoring and communication connection such as an Internet connection, the dispenser may transmit supply status data and usage statistics in real-time to a remote patient monitoring center and/or remote medication operations center. Such centers may comprise medication operations servers, patient monitoring servers, operations personnel, and monitoring personnel. Referring to FIG. 4, a sample monitoring display screen 140 according to an example embodiment is shown. The screen comprises identifying information for a patient 142, details regarding the patient's access to the tray and medicine dosages remaining 144, and image data from the camera 146. A service representative at the remote patient monitoring center 100 may review the information to determine whether medications have been taken as required or whether the patient may require some assistance. The representative may further determine whether the patient is in need of a replacement cartridge.

The automated prescription dispensing system and method of the present disclosure simplifies the administration of medication for elderly and chronically ill patients who may have difficulty adhering to a medication regime. The automated prescription dispensing system and method frees a patient, especially an elderly or frail patient, from worrying about which medication to take at which time. Patients that use numerous medications can dispose their unused or partially used pill bottles from prior hospital admissions that may be scattered around their home. The automated prescription dispensing system and method and the in-home prescription dispenser facilitates the proper administration of medicine and reduces the likelihood of various complications that may result from improper administration of medication as well as further admissions to in-patient facilities due to acute conditions arising from medication errors. The ability to adhere to a medication regime with assistance from an automated prescription dispensing system and method as disclosed may allow many patients to remain in their homes and to experience a higher quality of life.

While certain embodiments of the disclosed automated prescription dispensing system and method are described in detail above, the scope of the invention is not to be considered limited by such disclosure, and modifications are possible without departing from the spirit of the invention as evidenced by the claims. For example, elements of the dispenser user interface and cartridges may be varied and fall within the scope of the claimed invention. Various aspects of data transmission and the presentation of data at the remote centers may be varied and fall within the scope of the claimed invention. One skilled in the art would recognize that such modifications are possible without departing from the scope of the claimed invention.

What is claimed is:

1. A method for automating the dispensation of medication comprising the steps of:

receiving electronic medical record data at a server, wherein said electronic medical record data comprises identifying data and medication data for an individual;

analyzing said medication data to identify at least one medication for dispensation to said individual;

initiating an instruction to load said identified medication in an automated medication dispenser;

loading the automated medication dispenser with a dosing tray in the form of a replenishable, standardized cartridge; and receiving status data from said automated medication dispenser, wherein said status data comprises information regarding the dispensation of said identified medication from said automated medication dispenser including medication dosages remaining and at least one image of a user interacting with the automated medication dispenser from a monitoring component for capturing image data, wherein said monitoring component is in electronic communication with said automated medication dispenser.

2. The method of claim 1, wherein:

the monitoring component comprises a camera positioned to permit viewing the user as the user is interacting with the automated medication dispenser.

3. The method of claim 2, further comprising the step of:

viewing the user as the user is interacting with the automated medication dispenser.

4. The method of claim 3, wherein:

said camera is configured to capture still images of the user; and the step of viewing the user as the user is interacting with the automated medication dispenser is performed by viewing the still images.

5. The method of claim 3, wherein:

said camera is configured to capture a video of the user; and the step of viewing the user as the user is interacting with the automated medication dispenser is performed by viewing the video.

6. The method of claim 5, wherein:

said camera is configured to capture and transmit the video of the user in substantially real-time; and the step of viewing the video is performed in substantially real-time.

7. The method of claim 1, further comprising the steps of:

receiving revised medication data for the individual at the server;

analyzing said revised medication data to identify at least one new medication for said individual;

initiating a further instruction to load the identified new medication in the automated medication dispenser; and receiving additional status data from said automated medication dispenser, wherein said additional status data comprises information regarding dispensing of said identified new medication from said automated medication dispenser.

8. The method of claim 7, further comprising the steps of:

removing the dosage tray from the automated medication dispenser;

restocking the dosage tray with the identified new medication; and loading the automated medication dispenser with the restocked dosing tray.

9. The method of claim 1, further comprising the steps of:

receiving an alert from the automated medication dispenser, wherein said alert is provided in response to a request for assistance initiated by user actuation of a request for assistance button while using said automated medication dispenser.

10. The method of claim 1, further comprising the steps of:

receiving, from the automated medication dispenser, data representing the user's condition while using the automated medication dispenser.

11. The method of claim 1, wherein:

the step of analyzing said medication data to identify at least one medication for dispensation to said individual is performed at the server;

the step of initiating an instruction to load said identified medication in an automated medication dispenser is performed at a second server; and the step of receiving status data from said automated medication dispenser is performed at a third server.

12. A system for automating the dispensation of medication comprising:

a dosing tray in the form of a replenishable, standardized cartridge;

an automated medication dispenser configured to receive the dosing tray;

a first server comprising electronic medical record data and executable software instructions, wherein said electronic medical record data comprises identifying data and medication data for an individual, and wherein said executable software instructions, when executed, configure the first server to:

analyze said electronic medical record data to identify at least one medication for said individual, transmit said identifying data and said identified medication from said first server to a second server, and receive instructions from said second server to load said identified new medication in the dosing tray;

a monitoring component for capturing image data in electronic communication with said automated medication dispenser; and a third server configured to receive status data from said automated medication dispenser, wherein said status data comprises information regarding the dispensation of said identified medication from said automated medication dispenser, including medication dosages remaining and at least one image of a user interacting with the automated medication dispenser from the monitoring component.

13. The system of claim 12 wherein:

the monitoring component comprises a camera positioned to permit viewing the user as the user is interacting with the automated medication dispenser.

14. The system of claim 13 wherein:

said camera is configured and positioned to capture images of the user interacting with the automated medication dispenser.

15. The system of claim 14 wherein:

the camera is configured to capture still images.

16. The system of claim 14, wherein:

said camera is configured to capture videos.

17. The system of claim 16, wherein:

said camera is configured to capture and transmit videos substantially real-time.

18. The system of claim 12, wherein:

the first server is configured to receive revised medication data for the individual as well as further executable software instructions, which when executed configure the server to:

analyze said revised medication data to identify at least one new medication for said individual, transmit said identifying data and said identified new medication from the first server to the second server, and receive instructions from said second server to load said identified new medication in the dosing tray;

the third server is further configured to receive additional status data regarding dispensation of said identified new medication from said automated medication dispenser.

19. The system of claim 12, further comprising:

a button located on the automated medication dispenser, wherein actuation of the button is configured to cause the automated medication dispenser to transmit an alert to the third server indicating a request for assistance received from the user.

20. A method for automating the dispensation of medication comprising the steps of:

receiving electronic medical record data at a first server, wherein said electronic medical record data comprises identifying data and medication data for an individual;

analyzing, at said first server, said medication data to identify at least one medication for dispensation to said individual;

transmitting said identifying data and said identified medication from said first server to a second server;

initiating, from said second server, an instruction to load said identified medication in an automated medication dispenser;

loading the automated medication dispenser with a dosing tray in the form of a replenishable, standardized cartridge; and receiving status data from said automated medication dispenser at a third server, wherein said status data comprises information regarding the dispensation of said identified medication from said automated medication dispenser, including medication dosages remaining and at least one image of a user interacting with the automated medication dispenser from a monitoring component for capturing image data in electronic communication with said automated medication dispenser.

* * * * *